United States Patent [19]

Nissen

[11] 4,026,016

[45] May 31, 1977

[54] RAZOR BLADE ASSEMBLY

[75] Inventor: Warren I. Nissen, Topsfield, Mass.

[73] Assignee: The Gillette Company, Boston, Mass.

[22] Filed: May 12, 1975

[21] Appl. No.: 576,253

[52] U.S. Cl. ..... 30/47; 30/50; 30/87

[51] Int. Cl.[2] ..... B26B 21/06; B26B 21/22; B26B 21/52

[58] Field of Search ..... 30/47, 50, 57, 51, 85, 30/87, 89, 346–358

[56] References Cited

UNITED STATES PATENTS

| | | | |
|---|---|---|---|
| 1,234,834 | 7/1917 | Warren | 30/51 X |
| 1,455,726 | 5/1923 | Hartman | 30/89 X |
| 2,780,866 | 2/1957 | Borden | 30/87 X |
| 3,593,416 | 7/1971 | Edson | 30/57 X |
| 3,810,305 | 5/1974 | Perry | 30/47 |
| 3,935,639 | 2/1976 | Terry | 30/47 |

FOREIGN PATENTS OR APPLICATIONS

| | | | |
|---|---|---|---|
| 95,521 | 1/1910 | Austria | 30/87 |

*Primary Examiner*—Gary L. Smith
*Attorney, Agent, or Firm*—Richard A. Wise; Oistein J. Bratlie; Donald E. Mahoney

[57] ABSTRACT

A razor blade assembly is provided with blade means disposed between a cap member and a platform member and is adapted to be connected to a razor handle. The platform member has journal bearing means for receiving razor handle mounting means and cam means for receiving a biasing force exerted by said razor handle. The journal bearing means form a pivot axis for pivotal movement of the razor blade assembly thereabout and the platform member cam means is in engagement with a cam follower on the handle when the blade assembly is mounted on the razor handle.

18 Claims, 7 Drawing Figures

RAZOR BLADE ASSEMBLY

BACKGROUND OF THE INVENTION

1. Field of the Invention

This invention relates to wet shaving systems and, more particularly, to a razor blade assembly of the type in which a razor blade is secured in a permanent manner to a substantially rigid member provided with a guard surface spaced from a cutting edge of the razor blade.

2. Description of the Prior Art

Safety razors conventionally comprise a guard member and a cap member between which, in use, a disposable razor blade is sandwiched, and a handle, the guard member, the cap member, and the handle-being fixed relative to one another. The latter feature is present in the conventional one-piece and "three-piece" razors designed to take disposable double-edged blades. Safety razors have recently appeared on the market which comprise, instead of disposable razor blades, a disposable razor blade assembly, or head, having a guard member, one or more blades, and a cap member held rigidly together. The disposable razor blade assembly is rigidly attached to a handle so that the razor edges are at a fixed angular attitude relative to the handle. The blade assembly is replaced as a whole when the razor cutting edge (or edges) becomes dull.

Continuing efforts are being made to improve the shaving characteristics of such implements and/or to accommodate individual preferences. A factor in shaving efficiency and effectiveness is the orientation of the active components of the shaving system relative to the skin surface being shaved. The surface frequently has undulations or is in a relatively inaccessible or awkward area to reach and the shaving action is reduced in efficiency because the relationship of the active element to the skin surface being shaved significantly departs from the optimum value. Razors in which there is a fixed relationship between the shaving unit and the handle call for considerable dexterity on the part of the user and substantial changes in the disposition of the handle in order to maintain the shaving unit at its optimum attitude on the shaver's face, particularly when negotiating areas, such as the jaw line, where there are gross changes in facial contours.

It has been proposed, for example in U.S. Pat. No. 3,593,416, to improve the shaving characteristics of razors by providing a handle with a yoke structure and a blade assembly with pins projecting outwardly from opposite ends of the assembly, the pins of the blade assembly being received in the yoke structure so that the blade assembly may rock relative to the handle. Such a proposed arrangement has certain drawbacks and disadvantages, including cumbersome lengthening of the razor yoke structure beyond the ends of the blade assembly.

SUMMARY OF THE INVENTION

It is the object of the present invention to provide a razor blade assembly for use in a shaving implement in which the active portions of the shaving implement are movable relative to the grip portions of the implement and conformable or responsive to the surface of the skin being shaved. Accordingly, there is provided a razor blade assembly comprising blade means disposed between a cap member and a platform member and adapted to be attached to a razor handle having a cam follower means. The platform member has journal bearing means providing an axis permitting pivotal movement of the razor blade assembly upon the razor handle, and cam means for receiving a bias force from the cam follower means on the handle.

DESCRIPTION OF THE PREFERRED EMBODIMENT

Figure 1:
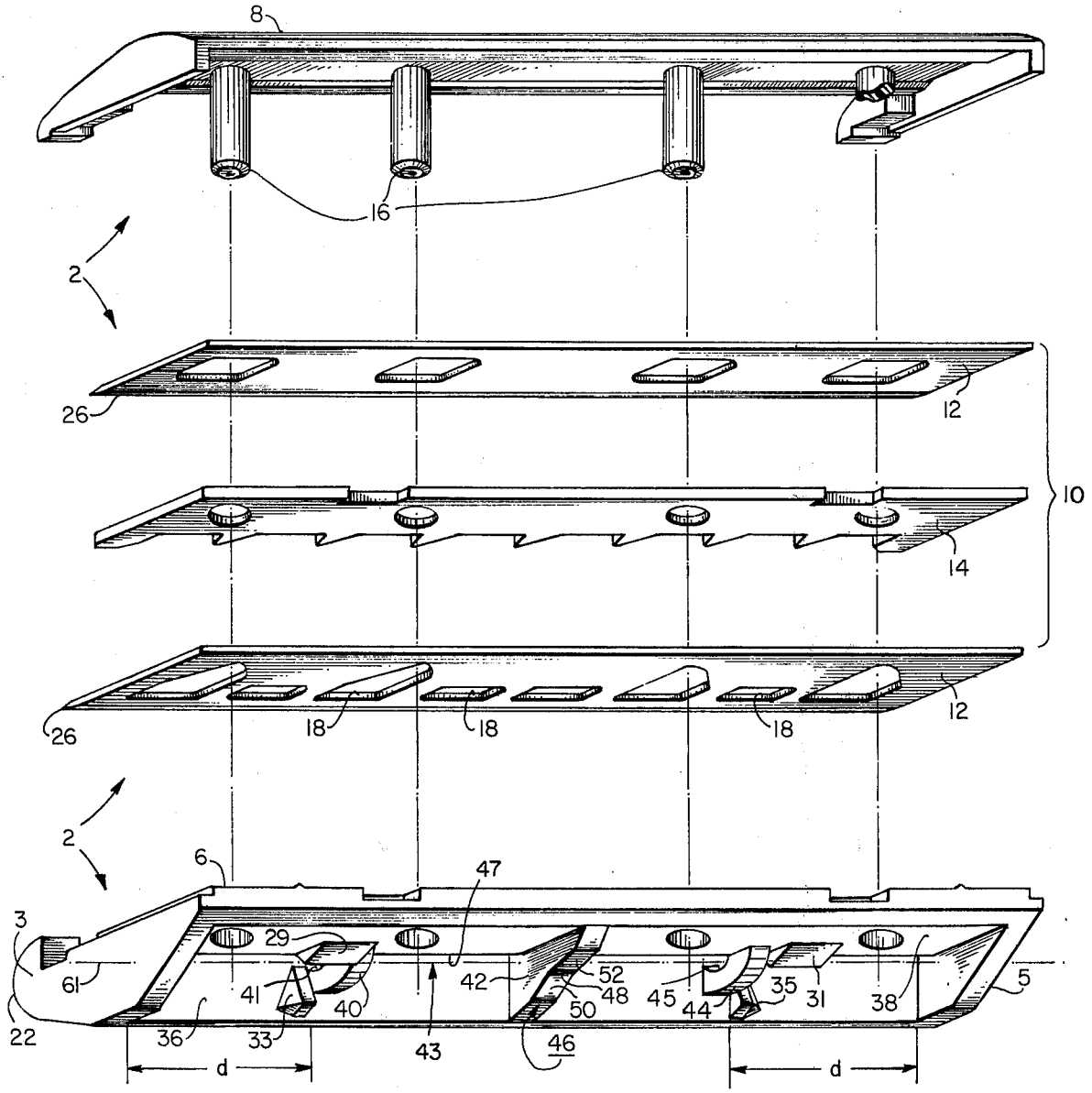
FIG. 1 is an exploded, perspective view of a razor blade assembly according to the invention.
Figure 3:
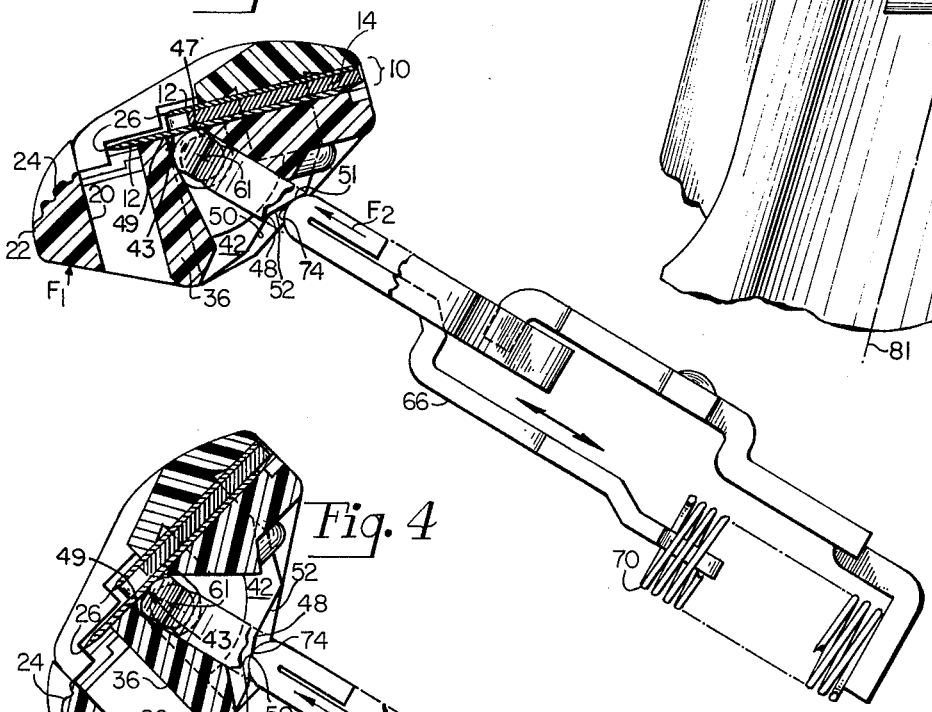
FIGS. 3 and 4 are side views, partially in section, of a cam follower member and a razor blade assembly according to the invention.
Figure 4:
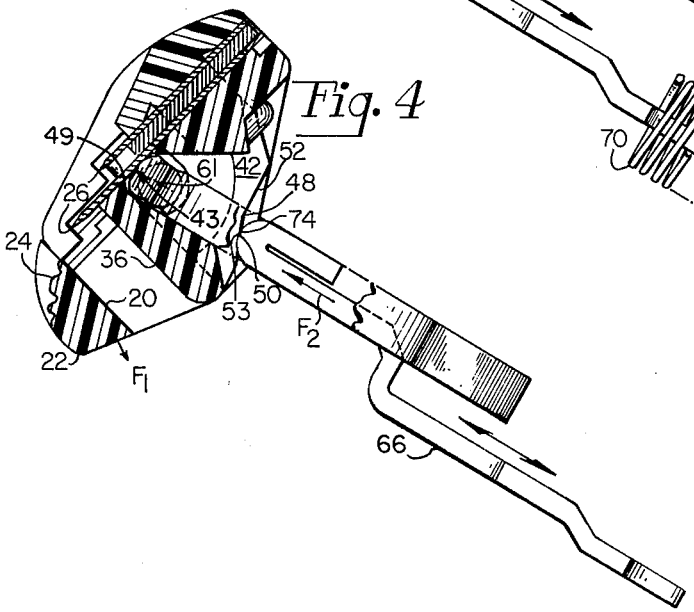

Referring to FIG. 1, it will be seen that the illustrative razor blade assembly 2 includes a substantially rigid platform member 6, a cap member 8, and a blade means 10 comprising one or more blade members 12. When the blade means 10 comprises more than one blade member 12, there may be included in the razor blade assembly 2, a spacer means 14 sandwiched between the two blade members 12, which in turn are sandwiched between the platform member 6 and the cap member 8. One or the other of the cap and platform member has posts 16 which are extended through openings in other portions of the razor blade assembly 2 and expanded rivet-like to permanently secure the various parts together. The blade means 10 and the platform 6 may be provided with passages 18 and 20, (FIG. 3) respectively, through which shaving debris may flow. The platform member 6 has a forward edge 22 providing a guard surface 24, as shown in FIGS. 3 and 4, extending substantially from a first platform end 3 (FIG. 1) to a second platform end 5 and spaced from one or more cutting edges 26 of the blade means 10.

Figure 2:
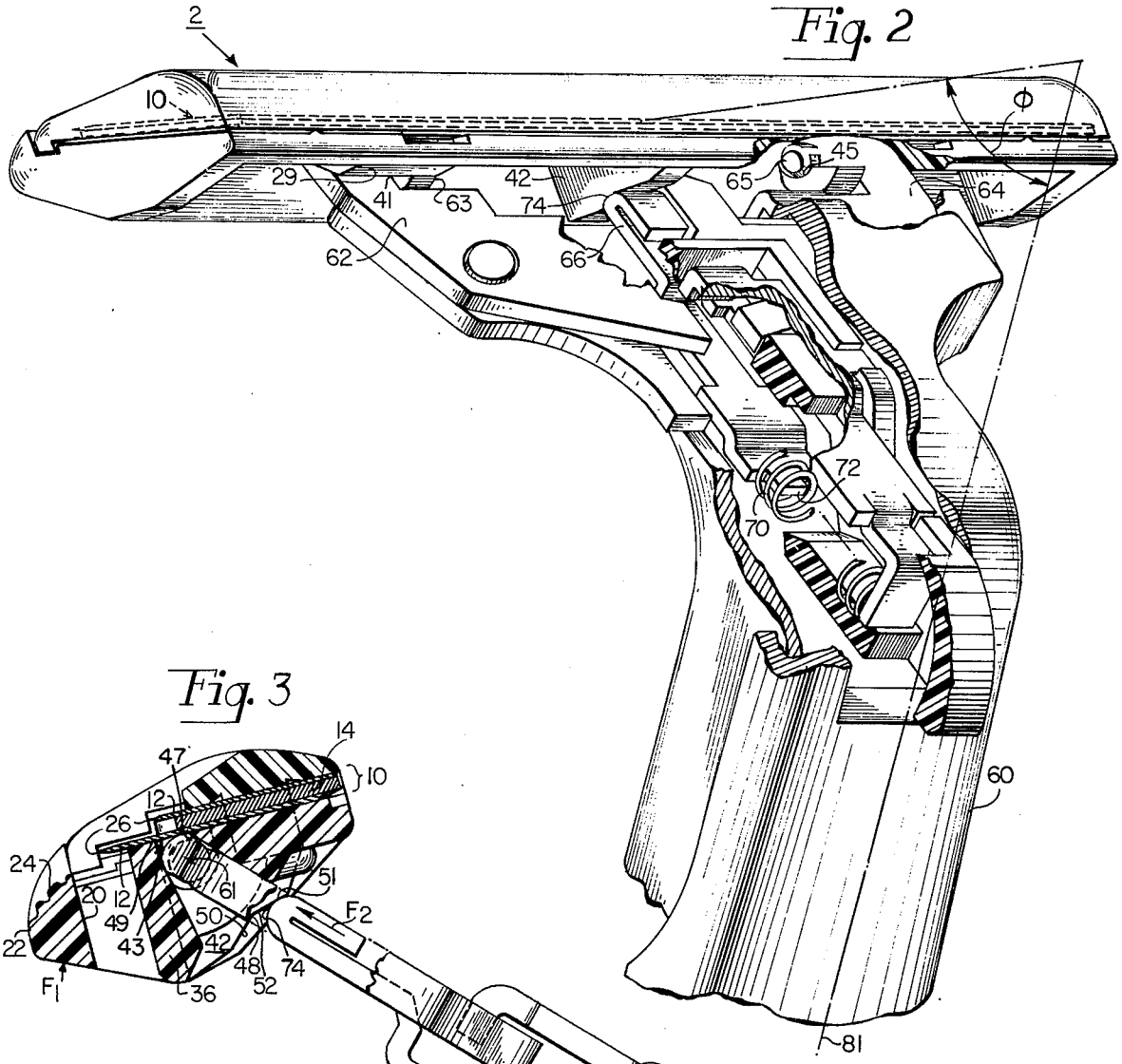
FIG. 2 is a perspective, partially cut-away view of a portion of a safety razor having a handle, and a razor blade assembly according to the invention.

The platform 6 in the illustrative embodiment includes a support member 36 extending between the platform ends 3 and 5. A portion of the support member 36 extends from a platform underside 38. The member 6 is further provided with support members 40 and 44 and a cam member 42 attached to the support member portion 36 and the platform underside 38 in substantially parallel planes generally transverse to the plane of the platform underside 38. Razor blade assembly stop members 29 and 31 are attached to the platform underside 38 and razor blade assembly stop members 33 and 35 are attached to support member 36 to limit angular movement of the razor blade assembly 2 when attached to a razor handle 60, as shown in FIG. 2 and described below. The support members 40 and 44 and cam member 42 are preferably molded integrally with the platform member 6 and span a gap 43 disposed between a forward edge 47 of the platform underside 38 and an upper edge 49 of the support member 36. The support members 40 and 44 are each located a distance, *d*, from the platform ends 3 and 5, respectively, and the cam member 42 is centrally located between the support members 40 and 44. Unlike prior art razor blade shaving units, such as described in U.S.

Pat. No. 3,724,070, the support members, 40 and 44, have apertures, 41 and 45, therein which comprise journal bearings for the reception of journal or axle means connected to a razor handle, as described below. In addition, the cam member 42 is arranged to have an angular-shaped cam surface 46 formed by oppositely inclined flat surfaces, 50 and 52, which intersect to form a dihedral angle with an apex 48. The journal bearings, 41 and 45, have axes aligned with each other to provide a pivot axis 61 substantially parallel to the razor edges 26 and located above the apex 48. Thus, the pivot axis 61 is closer to the platform underside 38 than the apex 48, as shown in FIGS. 3 and 4. As will be further described, the journal bearings, 41 and 45, and the cam member 42 on the platform underside 38 are arranged to cooperate with a razor handle to provide a safety razor with a razor blade assembly 2 which dynamically follows the contours of the area being shaved to produce optimum shaving results at all times.

Referring to FIG. 2, there is shown a perspective drawing, partially cut-away, of a safety razor having a razor handle 60 attached to the razor blade assembly 2 so that the blade members 12, shown in FIG. 1, dynamically follow the contours of the area being shaved. The razor handle 60 has arms, 62 and 64, with opposing journals, 63 and 65, and a substantially rigid cam follower member 66. The razor blade assembly 2 is attached to the handle 60 by inserting the journals 63 and 65, into the journal bearings, 41 and 45, shown in FIG. 1. The cam member 42 of the razor blade assembly 2 engages the cam follower member 66 in the handle 60 in response to a biasing force generated by a compressed spring 70, abutting an end 72 of the cam follower member 66. The spring 70 provides sufficient bias force, when compressed, to urge the end 74 of the cam follower member 66 against the cam member 42 and into the apex 48. The axes of the journal bearings, 41 and 45, are aligned with each other so that the razor blade assembly 2 may be pivoted upon the journals 63 and 65.

The surfaces, 50 and 52, are inclined at predetermined angles relative to the plane of the platform underside 38 so that the cam member 42 normally engages the cam follower member 66 substantially at the apex 48 to cooperatively urge the blade means 10 in the razor blade assembly 2 to be in a plane at a desired angular attitude, $\phi$, relative to the handle longitudinal axis 81 (FIG. 2). As the safety razor is moved along a skin surface, skin contours and convolutions act on the razor blade assembly 2 to generate torque producing forces which pivotally move the razor blade assembly 2 about the axis 61, causing the end 74 of the cam follower member 66 to move from the apex 48 to a point 51, for example, on the surface 52, as shown in FIG. 3, or to a point 53 on the surface 50, as shown in FIG. 4. The pivotal movement of the razor blade assembly 2 causes the cam follower member 66 to move along a substantially linear path within the handle 60 to further compress the spring 70 and to generate sufficient force, $F_2$, to restore the razor blade assembly 2 to its initial position. The load rate of the spring 70 and the angles of inclination of the surfaces, 50 and 52, relative to the plane of the platform underside 38 substantially determines the magnitude of the force, $F_2$. It is desirable to arrange the slope of the surfaces, 50 and 52, and the load rate of the spring 70 to provide a force, $F_2$, of sufficient magnitude to restore the razor blade assembly 2 to its initial position.

Figure 5:
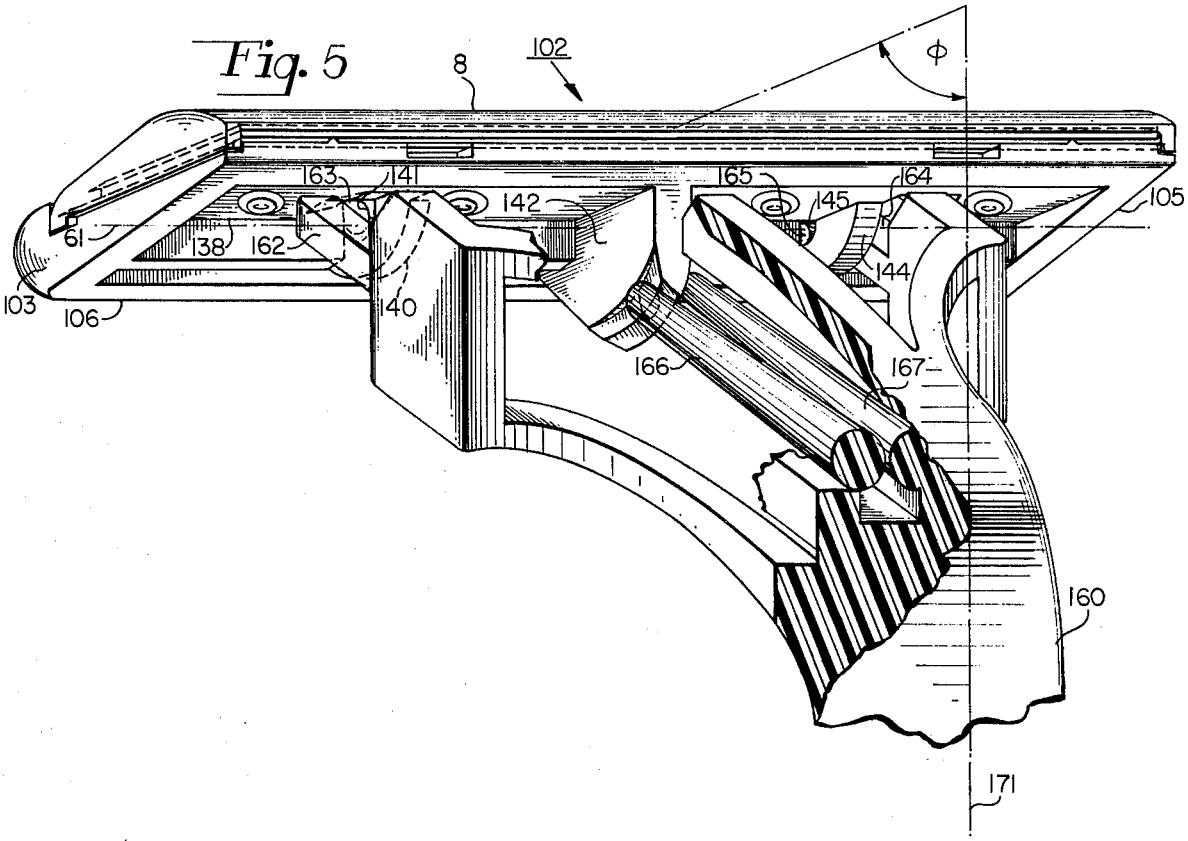
FIG. 5 is a perspective, partially cut-away view of a safety razor having a handle, and a razor blade assembly according to another embodiment of the invention.

Referring to FIG. 5, there is shown a perspective view, partially cut-away, of a safety razor having a razor handle 160 attached to another embodiment of a razor blade assembly 102 according to the invention. The razor blade assembly 102 has a substantially rigid platform member 106, a cap member 8, and a blade means 10 comprising one or more blade members 12 disposed between the platform member 106 and the cap member 8, as described above in reference to FIG. 1. In the alternative embodiment, the platform member 106 is provided with support members 140 and 144 and a cam member 142 molded integrally with the platform member 106. The support members 140 and 144 and the cam member 142 extend from a platform underside 138. Apertures, 141 and 145, in the support members, 140 and 144, provide journal bearings for opposing journals, 163 and 165, disposed on arms, 162 and 164, on the razor handle 160. The axes of the apertures, 141 and 145, are aligned with each other so that the razor blade assembly 102 may be pivoted upon the journals, 163 and 165, on a pivot axis 61 substantially parallel to razor edges 26 of the blade members 12.

Figure 6:
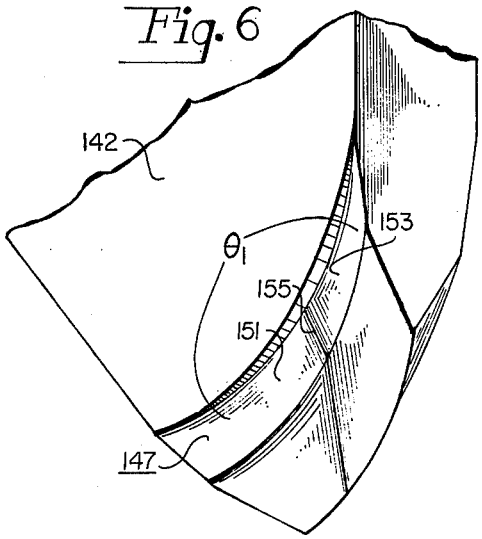
FIGS. 6 and 7 are perspective views of a cam member of the razor blade assembly shown in FIG. 5.
Figure 7:
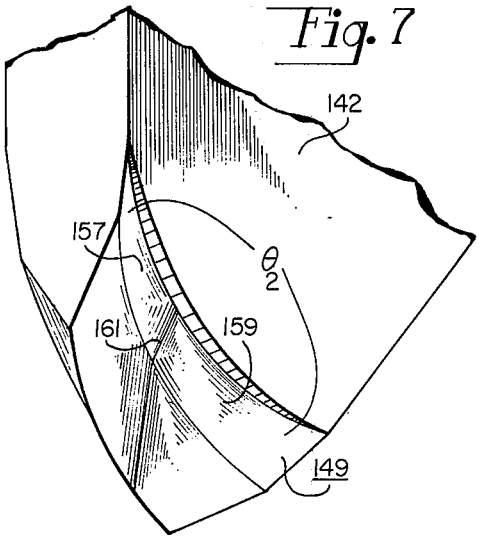

The cam member 142 has a plurality of cam surfaces 147, as shown in FIG. 6, and 149, as shown in FIG. 7. The cam surface 147 is formed by oppositely inclined surfaces 151 and 153 which intersect to form a dihedral angle, $\theta_1$, with an apex 155. The cam surface 149 is formed by oppositely inclined surfaces 157 and 159 which intersect to form a dihedral angle, $\theta_2$, with an apex 161. The journal bearings 141 and 145 have axes aligned with each other to provide a pivot axis 61 located above the apex 161 and the apex 155. Thus, the pivot axis 61 is closer to the platform underside 138 than either the apex 155 or the apex 161.

The razor handle 160 has, in addition to the opposing journals, 163 and 165, first and second cam follower members, 166 and 167, in the form of flexible rods. The razor blade assembly 102 is attached to the handle 160 by inserting the journals, 163 and 165, into the journal bearings, 141 and 145, and arranging cam member 142 to engage both the cam follower members, 166 and 167. The cam member 142 normally engages the cam follower member 166 at the apex 155 and the cam follower member 167 at the apex 161. The cam member 142 and the cam follower members 166 and 167 cooperatively urge the blade means 10 in the razor blade assembly 102 to be in a plane at a desired angular attitude, $\phi$, relative to handle longitudinal axis 171.

Examples of a razor blade assembly comprising blade means, a cap member and a platform member with journal bearing means and cam means extending from a platform member underside, have been disclosed. Numerous and varied other arrangements can readily be devised in accordance with the disclosed principles.

I claim:

1. A razor blade assembly comprising a platform member, a blade means, and a cap member, said blade means being permanently disposed between said platform member and said cap member;

journal bearing means disposed on said razor blade assembly and adapted for connection with journals disposed on a razor handle to form a pivot axis for pivotal movement of said razor blade assembly upon said razor handle; and cam means disposed on said razor blade assembly, said cam means including two intersecting surfaces forming a cavity having an internal angle with an apex removed from said pivot axis for receiving a biasing force from a cam follower means extending from said handle.

2. Razor blade assembly according to claim 1, wherein said razor blade assembly has first and second ends, and support means extending from said razor blade assembly intermediate said first and second ends.

3. Razor blade assembly according to claim 2, wherein said journal bearing means comprise apertures in said support means.

4. Razor blade assembly according to claim 1, wherein said cam means extend from said platform member.

5. Razor blade assembly according to claim 1, wherein said journal bearing means are disposed on said platform member.

6. A razor blade assembly comprising blade means, a cap member and a platform member, said razor blade assembly having journal bearing means therein for receiving journal means of a razor handle, and cam means for receiving a biasing force exerted by said razor handle, said journal bearing means forming a pivot axis for pivotal movement of said razor blade assembly thereabout, said cam means including two intersecting surfaces forming a cavity having an internal angle with an apex removed from said pivot axis, said cavity being in engagement with cam follower means extending from said razor handle when said blade assembly is attached to said handle.

7. Razor blade assembly according to claim 6, wherein said journal bearing means and said cam means are located on said platform member.

8. Razor blade assembly according to claim 6, wherein said platform member is permanently secured to said cap member with said blade means disposed there between.

9. A razor blade assembly comprising blade means disposed between a cap member and a platform member, said razor blade assembly being adapted to be connected to a razor handle having journal means for mounting said blade assembly thereon and a cam follower means for exerting a biasing force on said blade assembly, said razor blade assembly having journal bearing means for receiving said journal means on said handle to provide a pivot axis for said blade assembly, and cam means extending from said blade assembly, said cam means including two intersecting surfaces forming a cavity having an internal angle with an apex removed from said pivot axis for engagement with said cam follower means.

10. A razor blade assembly comprising blade means disposed between a cap member and a platform member and adapted to be attached to a razor handle having journal means for mounting said blade assembly and cam follower means for exerting a biasing force upon said blade assembly, said razor blade assembly including journal bearing means disposed therein and cam means disposed thereon, said journal bearing means being adapted to receive said journal means on said handle to attach said razor blade assembly to said handle, said journal bearing means providing a pivot axis for pivotal movement of said blade assembly thereabout, said cam means including two intersecting surfaces forming a cavity having an internal angle with an apex removed from said pivot axis for engagement with said cam follower when said blade assembly is attached to said handle.

11. A razor blade assembly according to claim 10, wherein said journal bearing means and said cam means are located on said platform member.

12. A razor blade assembly for attachment to a razor handle, said blade assembly comprising a platform means including a guard portion extending substantially from a first end of said blade assembly to a second end of said blade assembly, blade means, and cap means, said cap means and said platform means being permanently joined together with said blade means disposed therebetween, pivotal mounting means formed integrally with said blade assembly intermediate said first and second ends thereof for connection to complemental mounting means of said razor handle, said pivotal mounting means permitting pivotal movement of said blade assembly on said handle when said blade assembly is connected to said handle; and cam means formed integrally with said blade assembly intermediate said first and second ends, said cam means including two intersecting surfaces forming a cavity having an internal angle with an apex removed from a pivot axis provided by said pivotal mounting means.

13. A razor blade assembly according to claim 12, wherein said pivotal mounting means include journal bearing means located in said blade assembly.

14. A razor blade assembly for attachment to a razor handle, said blade assembly comprising molded plastic platform means, blade means, and cap means, said cap means and said platform means being permanently joined together with said blade means disposed therebetween, pivotal mounting means formed integrally with said platform means for engagement with complemental mounting means of said razor handle, said pivotal mounting means permitting pivotal movement of said blade assembly on said handle when said blade assembly is engaged with said handle, and cam means molded integrally with said platform means and extending therefrom, said cam means providing first and second substantially flat intersecting surfaces forming a cavity having an internal angle with an apex removed from a pivot axis defined by said pivotal mounting means, said flat surfaces of said cavity being adapted to receive cam follower means of said handle.

15. A razor blade assembly according to claim 14, wherein said pivotal mounting means includes journal bearing means located in said platform means.

16. A razor blade assembly for attachment to a razor handle, said blade assembly comprising platform means, blade means, and cap means, said blade means being disposed between said platform means and said cap means, and structure having journal bearing means therein for engagement with journal means of said razor handle, whereby said blade assembly is pivotally movable on said razor handle when said blade assembly is engaged with said razor handle, said journal bearing means defining an axis for said pivotal movement; and cam means extending from said platform means, said cam means including two intersecting surfaces forming a cavity having an internal angle with an apex removed from said axis.

17. A razor blade assembly according to claim 16, wherein said structure having said journal bearing means extends from said platform means.

18. A razor blade assembly according to claim 16, further including stop means extending from said platform means to limit the degree of said pivotal movement of said razor blade assembly.

* * * * *